US005269854A

United States Patent [19]

Takahashi et al.

[11] Patent Number: 5,269,854

[45] Date of Patent: Dec. 14, 1993

[54] REGENERATIVE MATERIAL

[75] Inventors: Akiko Takahashi, Tokyo; Yoichi Tokai; Masashi Sahashi, both of Kanagawa, all of Japan

[73] Assignee: Kabushiki Kaisha Toshiba, Kawasaki, Japan

[21] Appl. No.: 830,567

[22] Filed: Feb. 4, 1992

[30] Foreign Application Priority Data

Feb. 5, 1991 [JP] Japan ..... 3-014290

[51] Int. Cl.[5] ..... H01F 1/04

[52] U.S. Cl. ..... 148/301; 62/3.1; 62/6; 420/416

[58] Field of Search ..... 148/301; 420/416; 62/3.1, 6

[56] References Cited

U.S. PATENT DOCUMENTS

| | | | |
|---|---|---|---|
| 4,082,138 | 4/1978 | Miedema et al. | 165/4 |
| 4,378,258 | 3/1983 | Clark et al. | 148/100 |
| 4,849,017 | 7/1989 | Sahashi et al. | 75/245 |
| 5,124,215 | 6/1992 | Hashimoto | 428/611 |

FOREIGN PATENT DOCUMENTS

| | | | |
|---|---|---|---|
| 0191107 | 8/1986 | European Pat. Off. . | |
| 0217347 | 4/1987 | European Pat. Off. | 148/301 |
| 51-52378 | 5/1976 | Japan . | |
| 1-310269 | 12/1989 | Japan . | |
| 1089746 | 11/1967 | United Kingdom . | |

OTHER PUBLICATIONS

R. Li, et al., "Magnetic Intermetallic Compounds for Cryogenic Regenerator", *Cryogenics*, 6, 521-526, Jun. 30, 1990.

Hashimoto, et al., "Recent Advance In Magnetic Regenerator Material", *Cryogenics*, 30, 192-198, Sep. 30, 1990.

"Specific Heat and Entropy of $RHi_2$ (R: Rare Earth Heavy Metals) In Magnetic Field" by A. Tomokiyo et al., vol. 32, pp. 295-301.

"High Enthalpy Materials For Use In Superconductor Stabilzation And In Low Temperature Cryocooler Regenerators" by B. Barbisch et al., vol. 32 pp. 271-278.

*Primary Examiner*—John P. Sheehan

*Attorney, Agent, or Firm*—Finnegan, Henderson, Farabow, Garrett & Dunner

[57] ABSTRACT

The present invention provides a regenerative material having a peak specific heat at a low temperature. The material is made of a solid solution of at least two different magnetic type metal compounds, for example, ferromagnetic $Er_3Co$ and antiferromagnetic $Er_3Ni$. From these compounds, the regenerative material $Er_3(Ni,Co)$ in solid-solution form is produced and the material has a lower magnetic phase transition point than each of the compounds. The regenerative material is utilized for a regenerator of a refrigerator.

19 Claims, 9 Drawing Sheets

REGENERATIVE MATERIAL

BACKGROUND OF THE INVENTION

1. Field of the Invention

The present invention relates to a regenerative material which exhibits a large specific heat at a low temperature.

2. Description of the Related Art

In recent years, the technology of devices used in association with superconductor materials has advanced remarkably and has been applied to more and more technical fields. Along with the increasing use of superconductor technology, demands are increasing for a high-efficiency, small refrigerator for cooling superconductive components. There is a significant demand for a refrigerator which is light and small and has a high heat-efficiency. At present, such refrigerators are being developed in two ways. The first method is to enhance the efficiency of the existing gas-cycle refrigeration devices by adopting, for example, the Stirling cycle. The second method is to employ a new refrigerator in place of conventional gas-cycle refrigeration. A new refrigerator includes those using a heat-cycle, such as a Carnot-type and an Ericsson-type cycle, and the magnetocaloric effect.

Among the gas-cycle refrigerators with enhanced efficiency are: refrigerators which operate using the Stirling cycle and refrigerators which operate using the Gifford-McMahorn cycle. Each refrigerator has what is termed a regenerator which is packed with what is termed regenerative material. A working medium ($^4$He gas) is repeatedly passed through the regenerator to obtain a low temperature. More specifically, the working medium is first compressed and then made to flow in one direction through the regenerator. As the medium flows through the regenerator, heat energy is transferred from the medium to the regenerative material. When the medium flows out of the regenerator, it is expanded and its temperature is lowered further. The working medium is then made to flow in the opposite direction, through the regenerator again. This time heat energy is transferred from the regenerative material to the medium. The medium is passed twice, back and forth, through the regenerator in one refrigeration cycle. This cycle is repeated, thereby obtaining a low temperature.

The thermal characteristics of the regenerative material (sometimes referred to as its "recuperativeness"), and most significantly its specific heat, are the determinant of the efficiency of the refrigerator. The greater the recuperativeness regenerative materials have, the higher the heat-efficiency of each refrigeration cycle.

The regenerative materials used in the conventional regenerators are sintered particles of lead or mesh of copper or bronze or phosphor bronze. These regenerative materials exhibit a very small specific heat at extremely low temperatures of 20° K. or less. Hence, they cannot accumulate sufficient heat energy at extremely low temperatures in each refrigeration cycle of the gas-cycle refrigerator. Nor can they supply sufficient heat energy to the working medium. Consequently, a gas-cycle refrigerator which has a regenerator filled with such regenerative materials has a low cooling efficiency.

This problem can be solved by using regenerative materials which exhibit a large specific heat per unit volume (i.e., volume specific heat) at extremely low temperatures. Attention has been focused on some kinds of magnetic substances as such regenerative materials because their entropies greatly change at their magnetic phase transition temperature and show an anomalous specific heat (large specific heat). Hence, a magnetic substance that has an extremely low magnetic phase transition temperature can make an excellent regenerative material.

One such magnetic substance is the R-Rh intermetallic compound (where R is selected from the group consisting of: Sm, Gd, Tb, Dy, Ho, Er, Tm, and Yb). This material is disclosed in Japanese Patent Disclosure (Tokkai-sho) No. 51-52378. This group of intermetallic compounds has a maximal value of volume specific heat which is sufficiently great at 20° K. or less.

One of the components of this intermetallic compound is rhodium (Rh). Rhodium is a very expensive material and thus is not suitable as a regenerative material used in a regenerator where the regenerator may weigh in an amount of hundreds of grams.

Another regenerative material R-Mz (where R is selected from the group consisting of: Se, Y, La, Ce, Pr, Nd, Sm, Gd, Tb, Dy, Ho, Er, Tm, Yb, Lu, and M is selected from the group consisting of: Ni, Co, Cu, Ag, Au, Mn, Fe, Al, Zr, Pd, B, Si, P, C, and z has a value in the range of: $0.001<z<9.0$) has a large specific heat below 20° K. and is relatively inexpensive. Such a material is disclosed in Japanese Patent Disclosure (Tokkai-hei) No. 1-310269 corresponding to U.S. Ser. No. 305,169 filed Feb. 2, 1989 (now abandoned), the parent of U.S. Ser. No. 536,083 filed Jun. 11, 1990 (now abandoned), the parent of U.S. Ser. No. 804,501 filed Dec. 10, 1991 (pending).

The regenerative material R-Mz, however, does not have sufficient specific heat at extremely low temperature (4° K–5° K).

For a Helium refrigerator especially, one of the most important factors governing the refrigeration efficiency is that the regenerative material have a high specific heat at the intended temperature of operation of the refrigerator.

Accordingly, one of the objects of the present invention is to provide a regenerative material which has a maximum specific heat at low temperature.

Another object of the present invention is to provide a low-temperature regenerator which is filled with the regenerative material described above.

SUMMARY OF THE INVENTION

According to the present invention, there is provided a regenerative material which is characterized by its being composed of at least two metal compounds. At least two of the compounds have different magnetic types. The material is a solid solution of the two compounds with the magnetic phase transition point of the material being lower than the magnetic phase transition point of each of the compounds.

Preferably, each of the metal compounds includes at least one of the rare earth elements. It is further preferred that one of the metal compounds is ferromagnetic a second metal compound is anti-ferromagnetic. Most Preferably, the regenerative material comprises $Er_3$-(Ni,Co).

Another embodiment of the invention is a refrigerator including a regenerator wherein the regenerator comprises a regenerative material consisting essentially of at least two metal compounds. At least two of the compounds have different magnetic types. The material is a solid solution of the two compounds with the magnetic phase transition point of the material being lower than the magnetic phase transition point of each of the compounds.

BRIEF DESCRIPTION OF THE DRAWINGS

The objects and advantages of this invention will become more apparent and more readily appreciated from the following detailed description of the presently preferred embodiments of the invention taken in conjunction with the accompanying drawings wherein.

DESCRIPTION OF THE PREFERRED EMBODIMENTS

The present invention provides a regenerative material of which magnetic phase transition temperature has been lowered to values less than those of the starting substances by producing a solid-solution of two or more different magnetic metal compounds.

Magnetic ions bearing the above-mentioned magnetic phase transition, for instance, include rare earth elements (Ce, Pr, Nd, Pm, Sm, Eu, Gd, Tb, Dy, Ho, Er, Tm, Yb) ions or transition metal (Fe, Co, Ni, Mn, Cr). It is the 4f electron that creates the magnetic characteristics of these rare earth magnetic ions. However, as the 4f electron has an extremely strong locality and narrow extent of wave function, interaction among 4f electrons can be well described as an RKKY interaction with conduction electrons not as a direct interaction (direct exchange) by overlap of wave functions.

Hereinafter, the interactions between the magnetic ions are described in detail.

Figure 1:
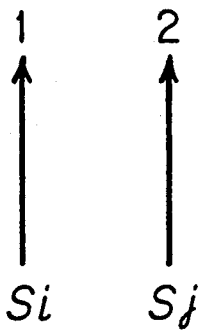
FIG. 1 is a diagram showing a parallel arranged spins ($J_{ij}>o$).
Figure 2:
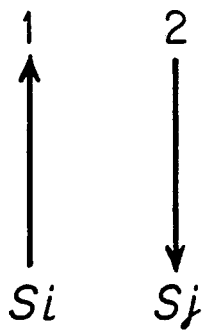
FIG. 2 is a diagram showing an anti-parallel arranged spins ($J_{ij}>o$).

First, they are considered from the microscopic viewpoint. Assuming that total spins of local electrons belonging to one magnetic ion of the i th site as $\bar{S}_i$, exchange interaction between magnetic ions can be generally expressed by $-J_{ii}(\bar{S}_i.\bar{S}_j)$ ($\bar{S}_i$; total spins of the i th magnetic ion, $\bar{S}_j$; total spins of the i th magnetic ion, $J_{ij}$; a coefficient showing the value of exchange interaction between total spins of the i th and the j th magnetic ions). The type of interaction between spins of magnetic ions differs depending upon the plus or minus symbol of this coefficient of interaction $J_{ij}$. That is, when $J_{ij}>0$, spins prefer to couple parallel each other (ferromagnetically) (see FIG. 1) and when $J_{ij}<0$, spins prefer to couple anti-parallel each other (antiferromagnetically) (see FIG. 2). In these figures, $\bar{S}_i$ and $\bar{S}_j$ are indicated with vector 1 and vector 2, respectively.

However, an actual system shows more complicated interactions as it is composed of a tremendous number of magnetic ions. The sum of the coefficients of magnetic interaction between magnetic ions for the entire substance (the amount proportional to the magnetic phase transition temperature) J (Q) can be defined by the following formula:

$$J(Q)=\Sigma Z_i J_{ij} e^{-iQR} \quad (1)$$

where, Q is the vector expressing the magnetic construction of a substance system and R is the vector directed to the j th magnetic ion from the i th magnetic ion.

Further, if $A_i=\Sigma Z_i \,.\, e^{-iQR}$, then formula (1) develops to $$J(Q)=A_1.J_1.A_2.J_2+A_3.J_3+ \quad (2)$$

Here, in a system where interaction among the magnetism bearing electron spins in the RKKY interaction, $J_{ij}$ (the coefficient of exchange interaction between magnetic ion spins) is a function of $k_F.R$. $k_F.R$ is a product of distance R between i th and j th spins, and Fermi wave numbers $k_F$. The relation between $k_F.R$ and J ($k_F.R$) is shown in FIG. 3.

Figure 3:
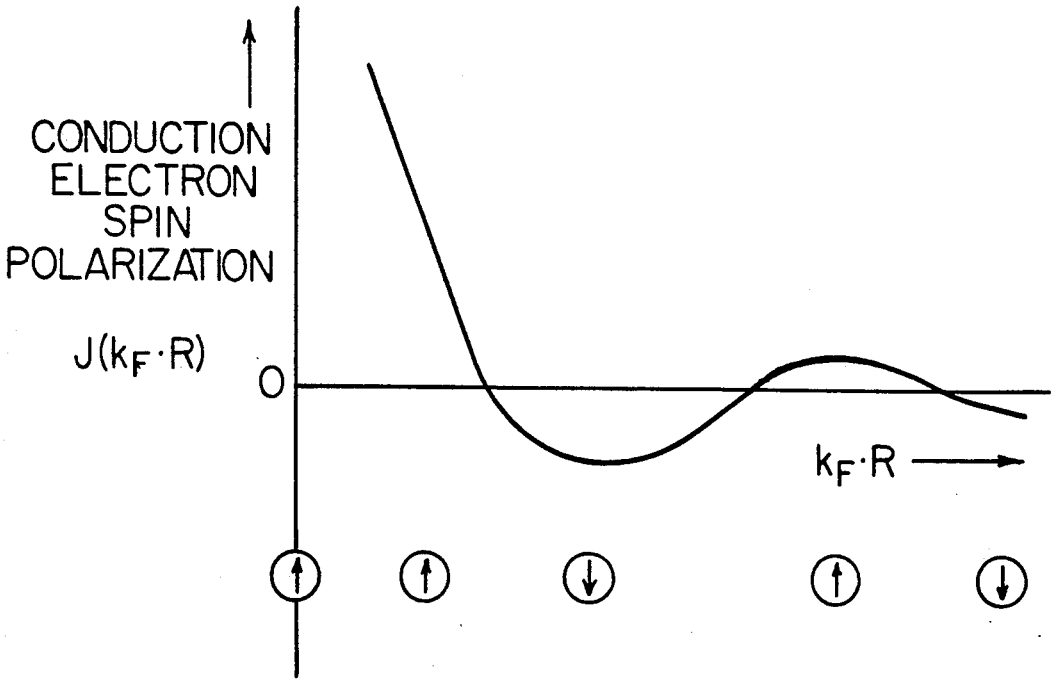
FIG. 3 is a diagram showing a function J $k_F.R$ expressing the intensities of the RKKY interaction.

As seen in FIG. 3, the interaction between the nearest neighbor magnetic ions is most strong in a magnetic substance. The other interactions become weaker by the screening effect of higher nearby magnetic ion interactions.

By such interactions of long-range orders described by the RKKY model, different type magnetic interactions such as ferro coupling and antiferro coupling compete with each other and as a result the value of interaction becomes small and thus, magnetic phase transition temperature can be lowered.

Figure 4:
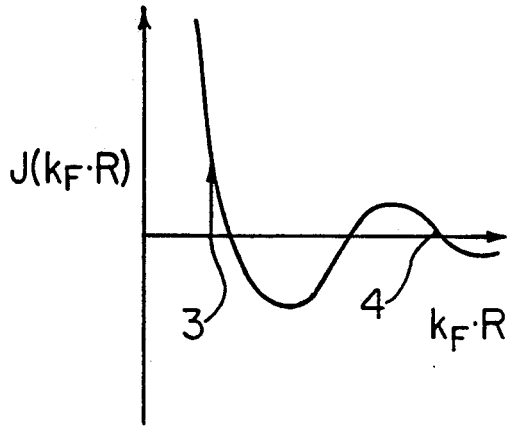
FIG. 4 to FIG. 9 are diagrams showing the relations between interaction values and the values of $k_F.R$.
Figure 5:
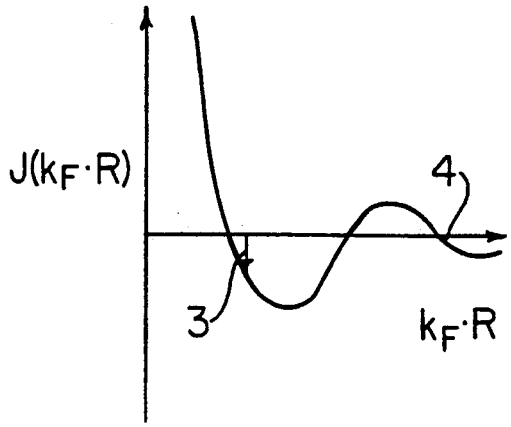

For instance, in a system where $J_1$ is dominant compared with $J_2$ and $J_3$, when the value of $J_1$ closes to the value of near equal to zero by controlling the $k_F.R$ value through an antiferromagnetic substance having ($J_1>0$, as shown in FIG. 4) being dissolved to a ferromagnetic substance having ($J_1<0$, as shown in FIG. 5) in a solid-solution, then the interaction becomes weak and the magnetic phase transition temperature can be lowered.

Figure 6:
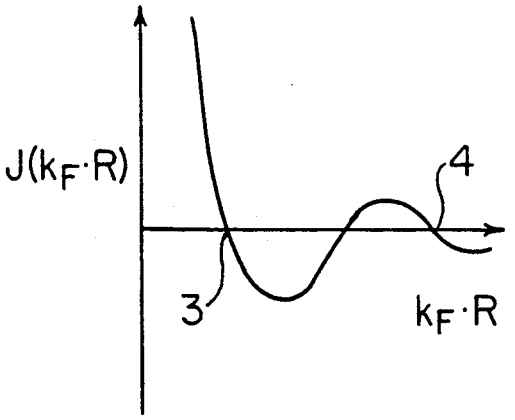

Values of the interaction J between the nearest neighbor magnetic ions (indicated with number 3) and the second neighbor magnetic ions (indicated with number 4) are shown in FIGS. 4–6.

Figure 7:
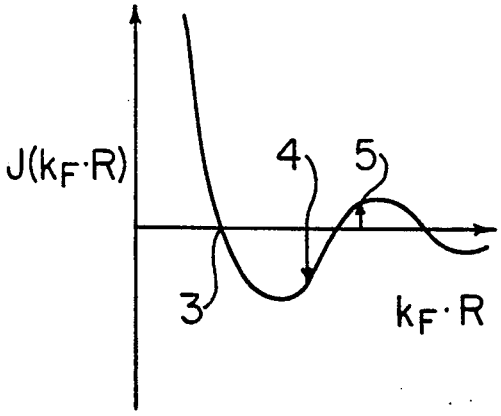
Figure 8:
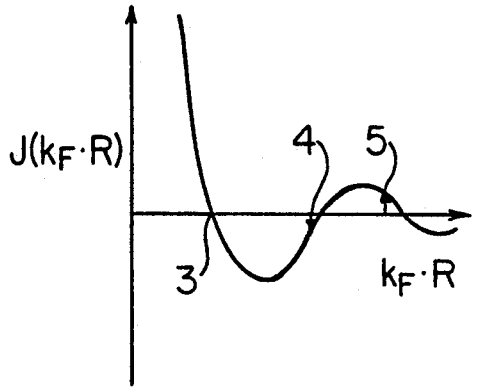
Figure 9:
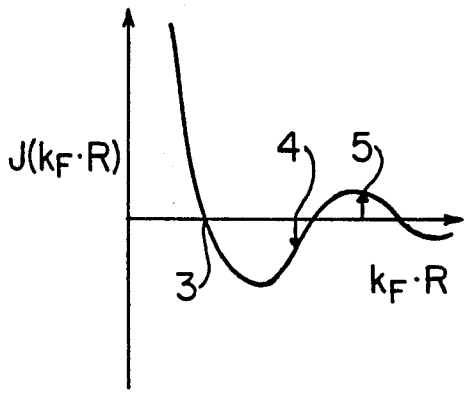

Further, in a system where $J_2$ and $J_3$ cannot be disregarded for high order interactions compared with $J_1$, when systems where the $J_1$ value is almost 0 and $J_2$ and $J_3$ have values as shown in FIG. 7 and in FIG. 8 are placed in a solid-solution, then $J_2$ and $J_3$ are cancelled (as shown in FIG. 9) or $k_F.R$ is controlled in a manner to cancel the entire $J_1$, $J_2$ and $J_3$. In these cases the interaction becomes weak and the magnetic phase transition point can be lowered. Values of the interaction J between the third neighbor magnetic ions are also indicated with number 5 in FIGS. 7 to 9.

The following combinations can be pointed out as definite examples of the combination of at least two kinds of different magnetic type substances:

1. $Er_3(Ni_{1-x}Co_x)$

A combination in a solid-solution state of $Er_3Co$ and $Er_3Ni$, where $Er_3Co$ is a ferromagnetic substance having a Curie temperature ($T_c$) of 13° K. $Er_3Ni$ is an antiferromagnetic substance having a Neel temperature ($T_N$) of 6° K.

2. $(Er_{3-x}Ho_x)Al_2$

A combination in a solid-solution state of $Ho_3Al_2$ and $Er_3Al_2$, where $Ho_3Al_2$ is a ferromagnetic substance of which $T_c$ is 33° K. $Er_3Al_2$ is an antiferromagnetic substance of which $T_N$ is 9° K.

3. $(Er_{1-x}Ho_x)Al$

A combination in a solid-solution state of HoAl and ErAl, where HoAl is a ferromagnetic substance of which $T_c$=26° K. ErAl is an anti-ferromagnetic substance of which $T_N$=13° K.

As described above, the technology involved in the present invention is capable of making an alloy of two or more different magnetic type substances (for instance, ferromagnetic and antiferromagnetic substances, ferromagnetic substance and ferrimagnetic substance, ferrimagnetic substance and antiferromagnetic substance, etc.). Such materials find utility as a regenerative component in a refrigerator. Such materials utilize the anomaly of a large specific heat being associated with magnetic phase transitions at low temperature, caused by having different type magnetic interactions compete with each other to lower the magnetic phase transition temperature (the temperature at which the specific heat shows a peak value) below those of the starting component materials. By controlling this the specific heat corresponding at a desired temperature of operation of a gas refrigerator can be obtained.

Figure 10:
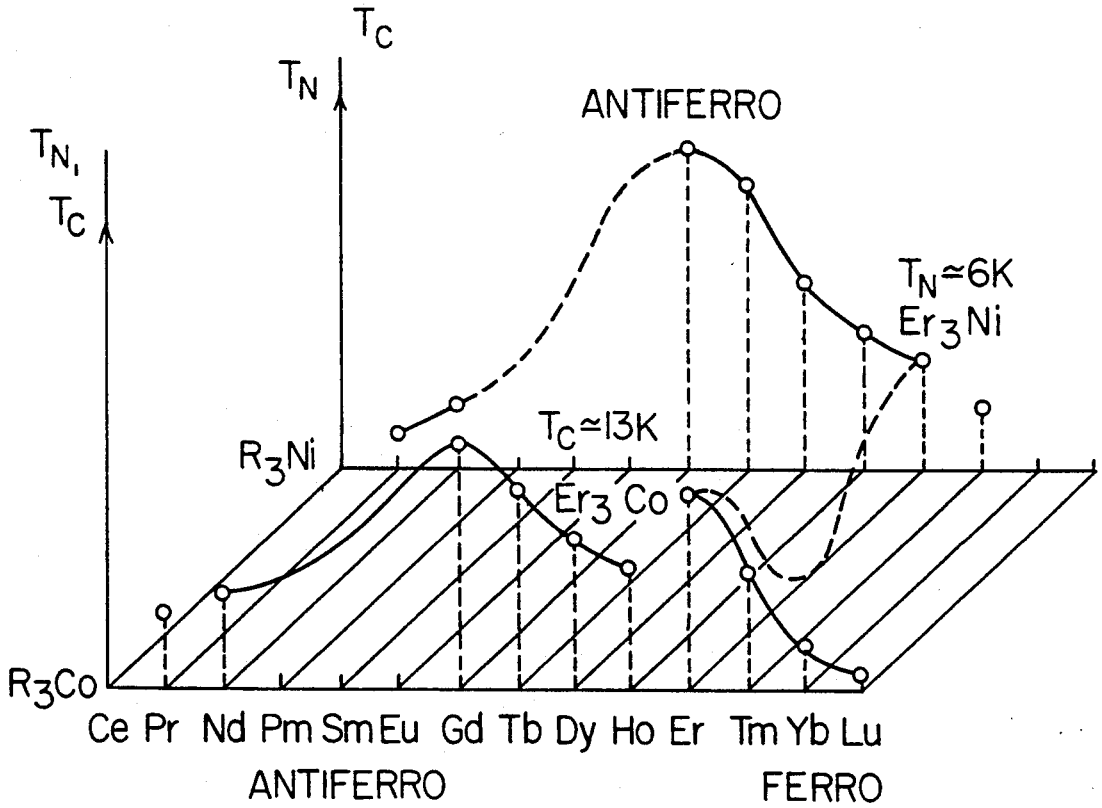
FIG. 10 is a diagram showing relations between transition types and phase transition temperatures in $R_3T$, wherein: R=rare-earth element, T=Ni or Co element.
Figure 11A:
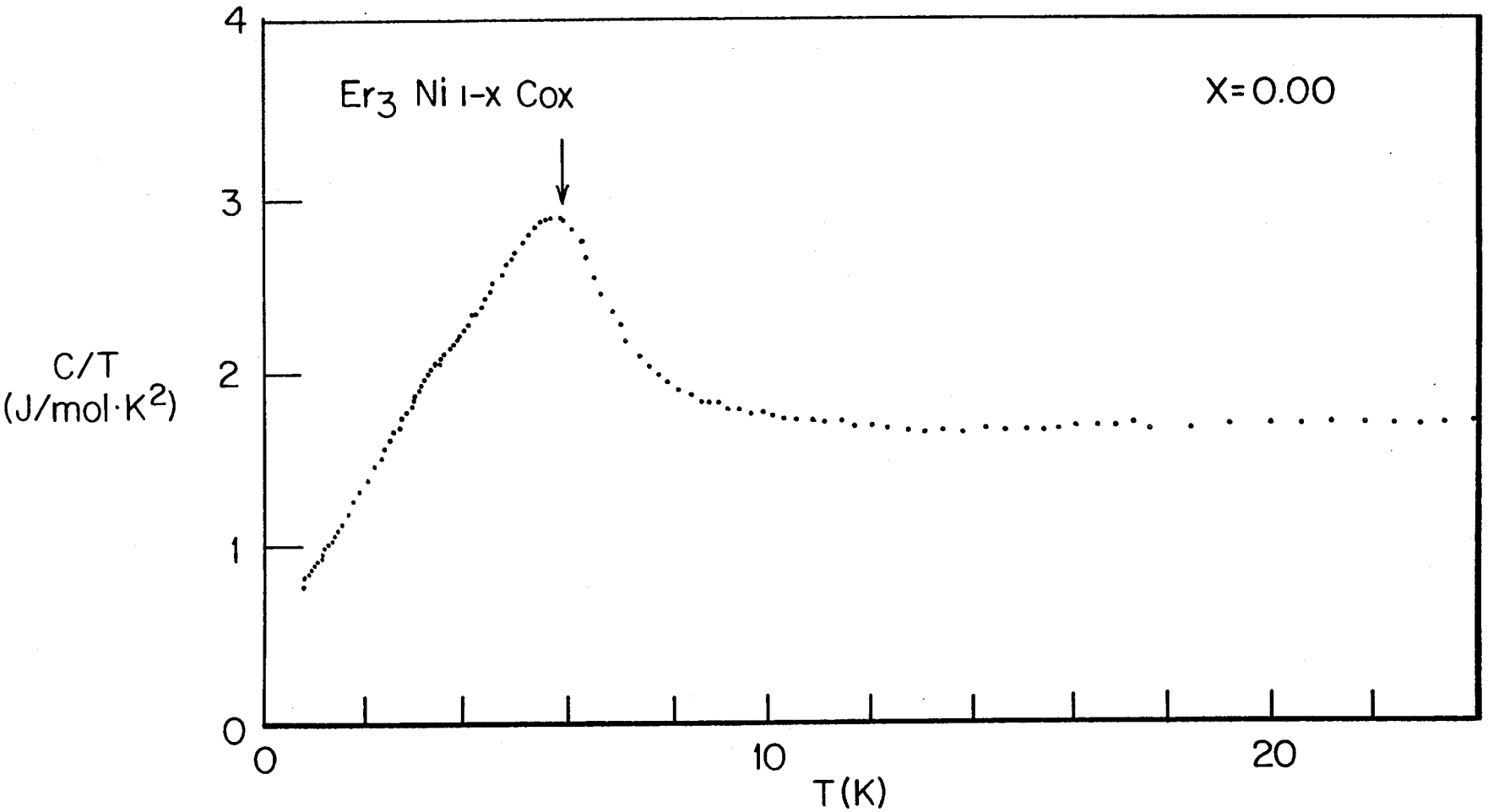
FIG. 11(*a*) to (*e*) are diagrams showing the characteristics of C/T value for temperature.
Figure 11B:
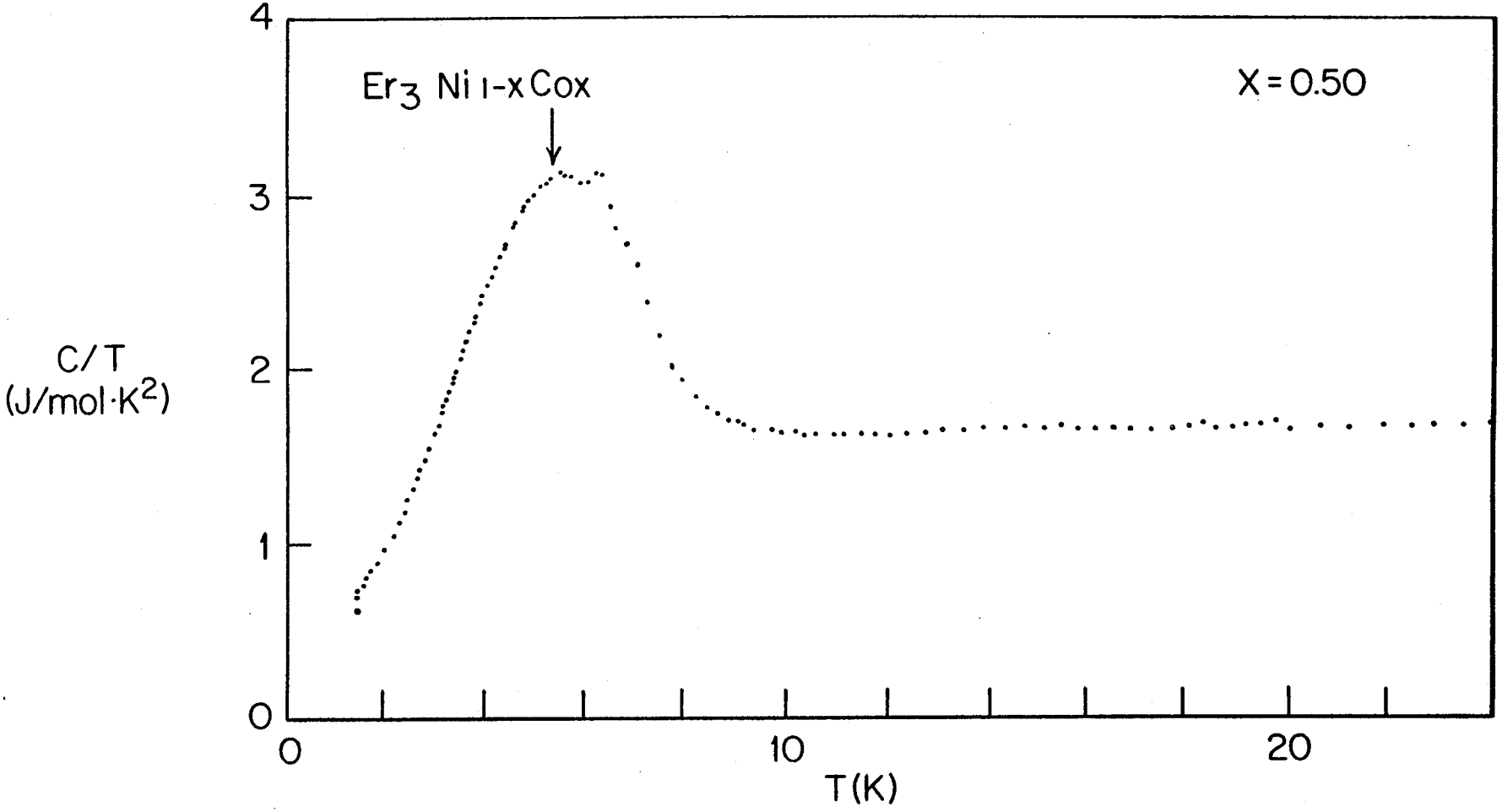
Figure 11C:
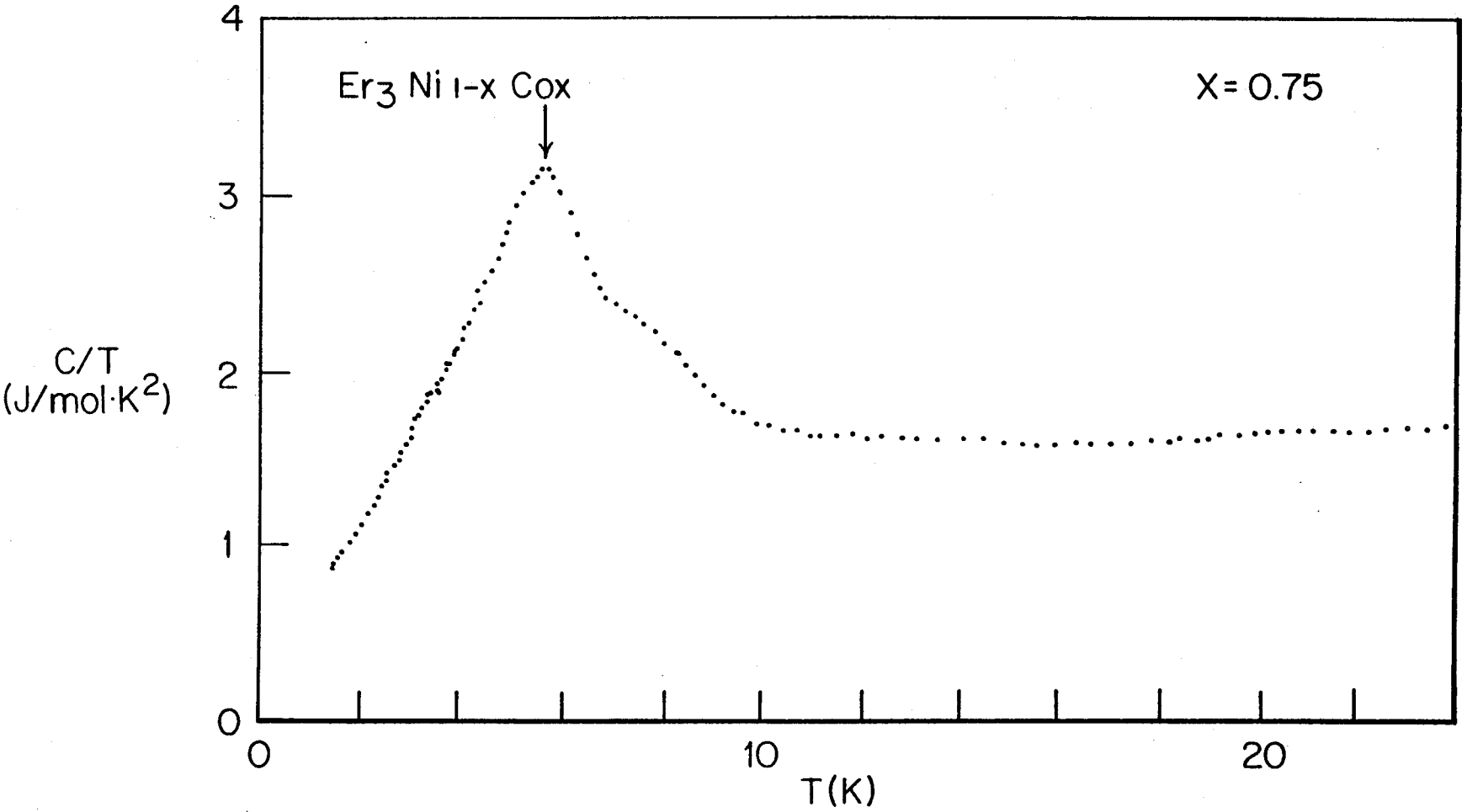
Figure 11D:
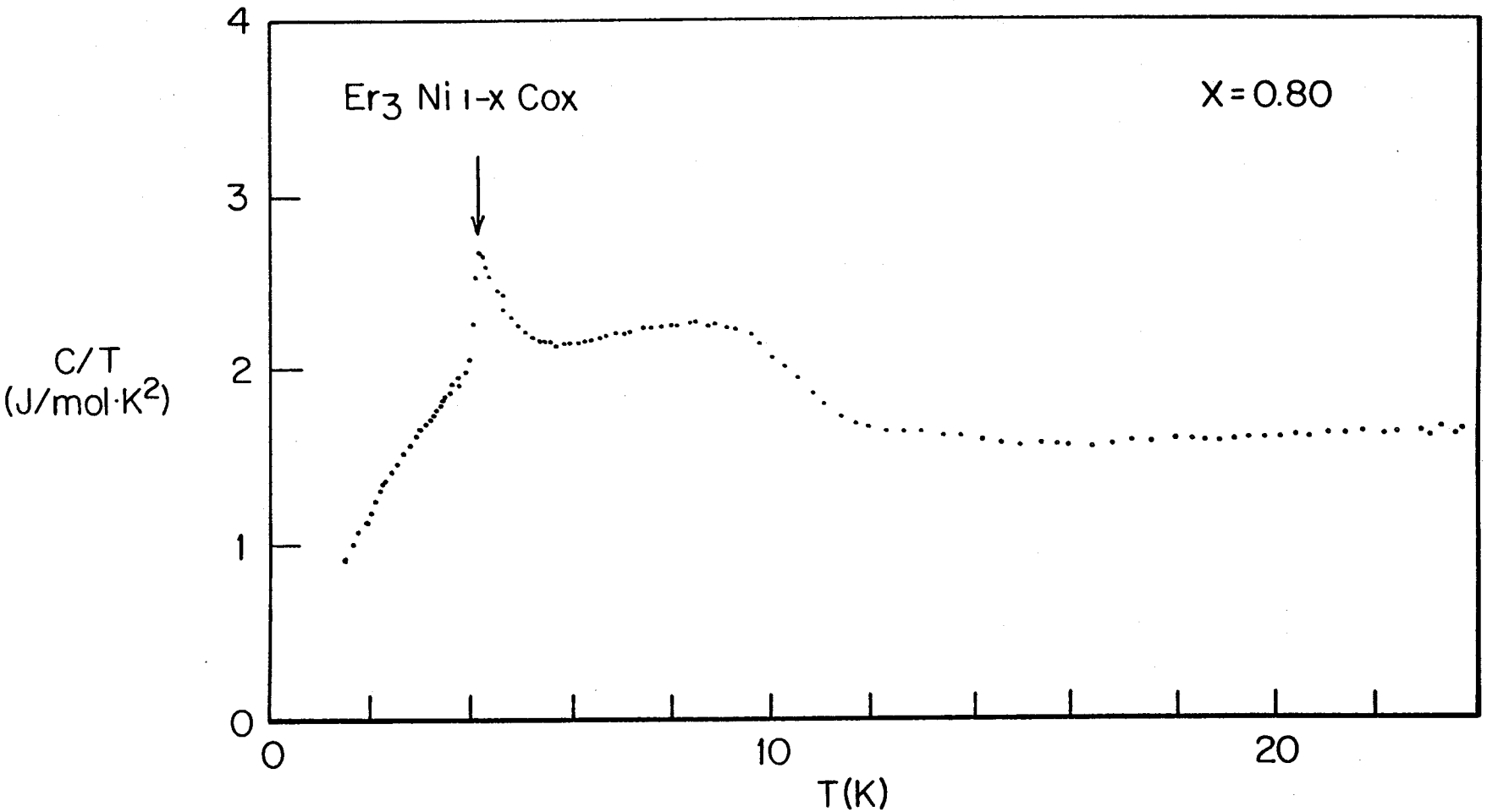
Figure 11E:
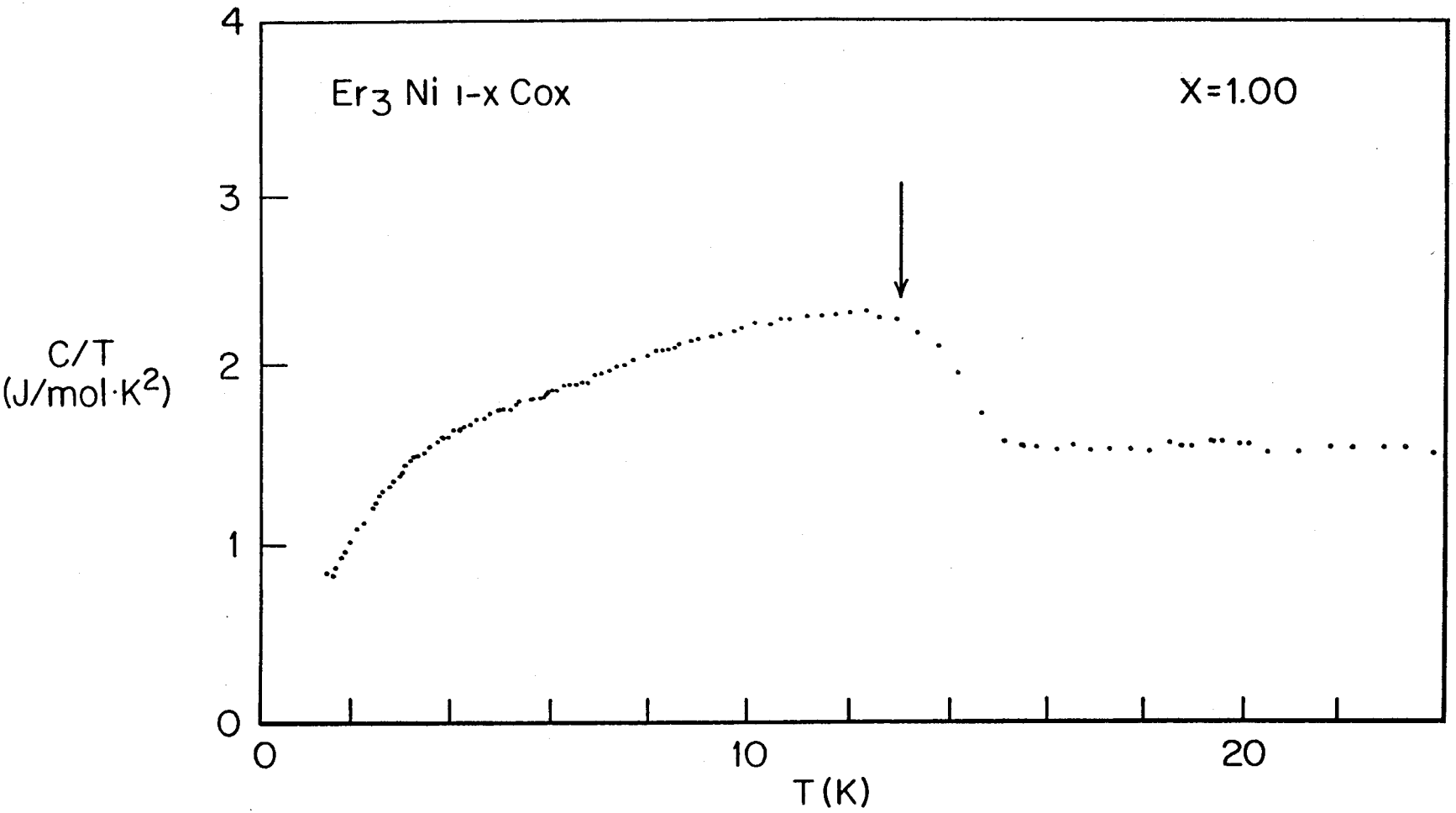

Further, the present invention is able to provide a regenerative material with a magnetic phase transition temperature controlled to provide a large specific heat corresponding to an objective temperature of a gas refrigerator which has a refrigerating efficiency similar to Pb, that is a conventional refrigerating substance in a temperature region near 20° K. The invention also has a large specific heat associated with the above-mentioned magnetic phase transition even in a low temperature region below 10° K. If the Debye temperature of the material is less than or nearly equal to that of Pb (below about 120° K), the specific heat of the lattice is sufficiently large and similar to that of Pb in a temperature range of 10°–40° K. If the energy gap between the ground state and excited state of electrons which play important role in magnetism in the material is relatively small (5° K$\leqq\Delta E\leqq$50° K), the specific heat shows the effect of the Schottky anomaly. Thus, a large specific heat is obtained due to the addition of the Schottky anomaly contribution to the contribution of the ordinary lattice in a temperature range of 10°–40° K. The magnetic-phase transition temperatures of $R_3Ni$ system and $R_3Co$ system (R: rare-earth element) are shown in FIG. 10 three-dimensionally.

It is specially noteworthy that $Er_3Ni$ has the antiferromagnetic interaction and $Er_3Co$ has the ferro interaction from the groups of $R_3Ni$ system and $R_3Co$ system.

EXAMPLES

Mixed powders consisting of Er 75 atom %, Ni 12.5 atom % and Co balance were prepared and melted by an arc melting furnace. The melted material was then annealed at about 700° C. for 100 hours in a vacuum condition (about $10^{-3}$ Torr). This material is identified as example 1.

Two different mixed powders were also prepared. One consisted of Er 75 atom %, Ni 6.25 atom % and Co balance, the other was Er 75 atom %, Ni 5.0 atom % and Co balance. They were also melted and annealed in the same conditions as described above. These materials comprise examples 2 and 3 respectively.

Finally, three different compositions of regenerative material of $Er_3$ (Ni,Co) were produced. According to the X-ray diffraction pattern of each obtained material, it was confirmed that a single phase of an intermetallic compound having a crystal structure of $Er_3$(Co,Ni) was formed, a pseudobinary system of two different magnetic type intermetallic compounds. The value of $T_c$ of $Er_3Co$ is about 13° K, while the $T_N$ of $Er_3Ni$ is about 6° K. There are peaks of specific heat for these materials correspond to these magnetic phase transition temperatures.

Refrigeration occurs by the entropy exchange between the regenerative material and the working fluid, as for example, He. Therefore when the regenerative efficiency of a material is evaluated, a parameter C/T is very illustrative because the value of C/T indicates the entropy exchange directly. (C is a value of specific heat at a certain temperature, and T is a value of the temperature).

The characteristics of C/T as a function of T in the case of $Er_3Ni$ and $Er_3Co$ is shown in FIGS. 11(*a*) and FIG. 11(*e*) respectively.

The characteristics of C/T as a function of T in the case of examples 1 to 3 are also shown in FIGS. 11(*b*), 11(*c*) and 11(*d*), respectively.

These values of C/T were estimated by using the specific heat of those bulk form specimens.

As shown in FIG. 11(*b*) in the case of the material including Ni 12.5 atom % the peak position of C/T (indicated by an arrow) is obtained at a value of T of about 5.5° K. As shown in FIG. 11(*c*) in the case of the material including Ni 6.25 atom % the peak position of C/T is obtained at a value of T of about 5.7° K. As shown in FIG. 11(*d*) in the case of the material including Ni 5.0 atom % the peak position of C/T is obtained at a value of T of about 4° K. All of these three temperatures at the peak positions are lower than the individual peak position temperatures for either $Er_3Ni$ or $Er_3Co$.

The materials of the present invention have larger values of C/T at lower temperatures. The C/T peak position temperature corresponds to the specific heat peak position temperature in the same regenerative material.

Figure 12:
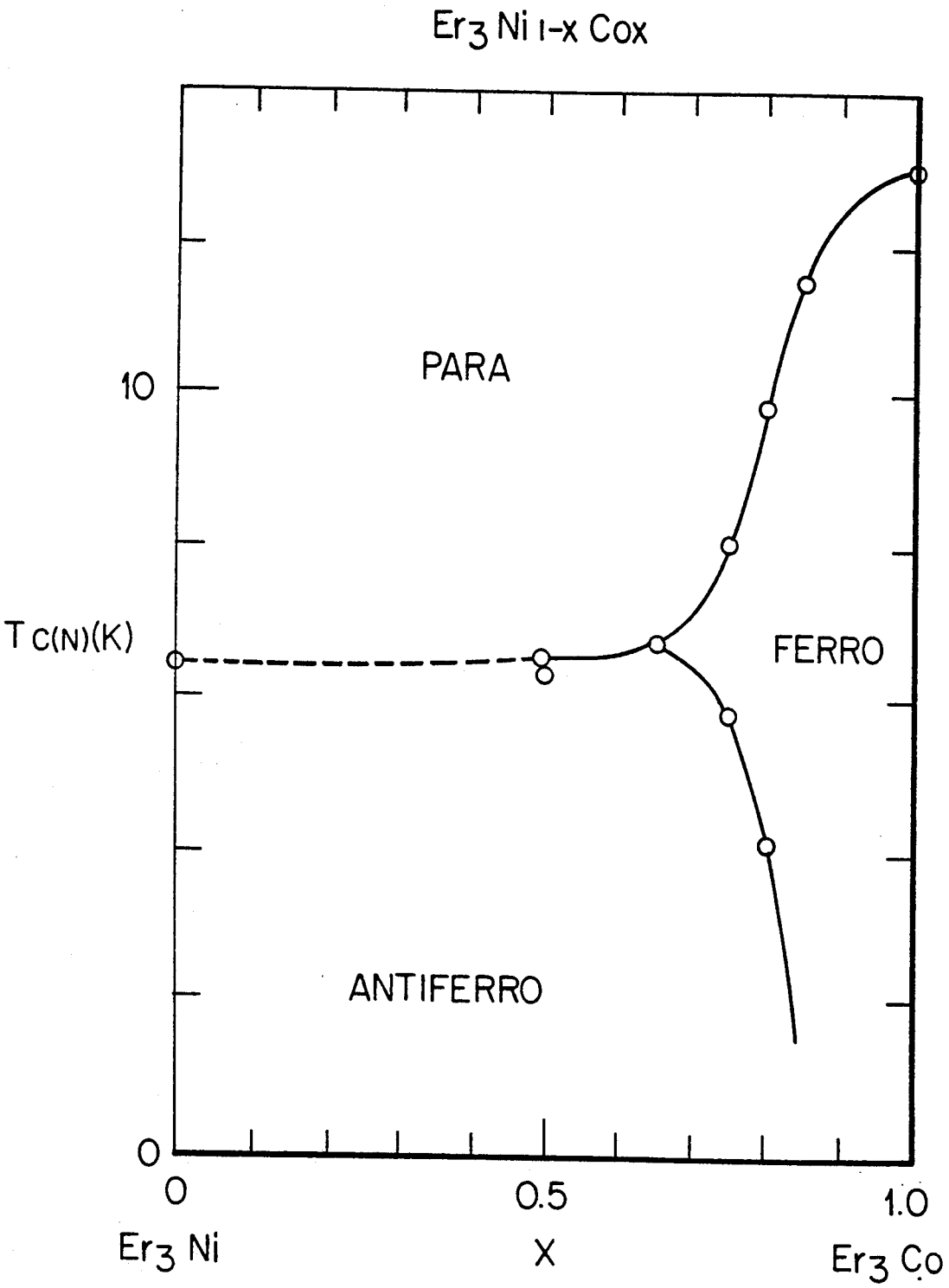
FIG. 12 is a phase diagram showing the composition dependence of the magnetic phase transition temperature in $Er_3Ni_{1-X}Co_X$.

The composition dependence of the magnetic phase transition temperature in the $Er_3Ni_{1-x}Co_x$ system is shown in FIG. 12. As shown in FIG. 12, in the region where the value of X is about 0.5 or more, preferably between about 0.65 and about 0.85 (x being the content of the element of Co) there is an area of lower transition temperature. Thus, comparing with $Er_3Co$ or $Er_3Ni$ each, more efficient refrigeration in a lower temperature region can be provided by the present invention.

As described above, according to the present invention, regenerative materials utilizing anomally of a large specific heat associated with the magnetic phase transition at low temperature may be used to provide a regenerative material made from two or more different magnetic type substances. The regenerative material, having different type magnetic interactions compete with each other and thus lower the magnetic phase transition temperature (a temperature at which specific heat shows the peak value) compared with the values of the constituent materials. Further, the material also can provide a device having a relatively large specific heat at a temperature of operation of a refrigerator lower than conventional materials that do not control the magnetic phase transition temperature in the manner of the present invention.

The present invention has been described with respect to specific embodiments. The present invention is, however, not limited thereto. The scope of the invention is to be determined by the appended claims and their equivalents.

We claim:

1. A regenerative material which comprises at least two metal compounds wherein at least two of said compounds are of different magnetic classes, said material being a solid solution of said compounds, the magnetic transition temperature of said material being lower than the magnetic transition temperature of each of said compounds.

2. The regenerative material of claim 1, wherein each of said metal compounds includes at least one of the rare earth elements.

3. The regenerative material of claim 1, wherein one of the metal compounds is ferromagnetic and a second metal compound is antiferromagnetic.

4. The regenerative material of claim 1, wherein the representative material comprises $Er_3(Ni_{1-x},Co_x)$, where $0.0<x<1.0$.

5. The regenerative material of claim 1, wherein the regenerative material consists essentially of $Er_3(Ni_{1-x},Co_x)$, where $0.0<x<1.0$.

6. The regenerative material of claim 1, wherein the regenerative material comprises $Er_3(Ni_{1-x}Co_x)$, where x is 0.5 or more.

7. The regenerative material of claim 1, wherein the regenerative material comprises $Er_3(Ni_{1-x},Co_x)$, where $0.65 \leqq \times \leqq 0.85$.

8. The regenerative material of claim 1, wherein the regenerative material has a magnetic transition temperature of less than 6° K.

9. A refrigerator including a regenerator wherein said regenerator comprises a regenerative material consisting essentially of at least two metal compounds wherein at least two of said compounds are of different magnetic classes, said material being a solid solution of said compounds, the magnetic transition temperature of said material being lower than the magnetic transition temperature of each of said compounds.

10. The refrigerator of claim 9, wherein said metal compounds include at least one of the rare earth elements.

11. The refrigerator of claim 9, wherein one of the metal compounds is ferromagnetic and a second metal compound is anti-ferromagnetic.

12. The refrigerator of claim 9, wherein the regenerative material comprises $Er_3(Ni_{1-x},Co_x)$, where $0.0<x<1.0$.

13. The refrigerator of claim 9, wherein the regenerative material consists essentially of $Er_3(Ni_{1-x}, Co_x)$, where $0.0<x<1.0$.

14. The refrigerator of claim 9, wherein the regenerative material comprises $Er_3(Ni_{1-x}Co_x)$, where x is 0.5 or more.

15. The refrigerator of claim 9, wherein the regenerative material comprises $Er_3(Ni_{1-x}Co_x)$, where $0.65 \leqq x \leqq 0.85$.

16. The regenerative material of claim 1, wherein said metal compounds are selected from the group consisting of ferromagnetic material, antiferromagnetic material, and ferrimagnetic material.

17. The refrigerator of claim 9, wherein said magnetic metal compound are selected from the group consisting of ferromagnetic material, antiferromagnetic material, and ferrimagnetic material.

18. The regenerative material of claim 2, wherein at least one of said metal compounds includes a transition metal.

19. The refrigerator of claim 11, wherein at least one of said metal compounds includes a transition metal.

* * * * *

UNITED STATES PATENT AND TRADEMARK OFFICE

CERTIFICATE OF CORRECTION

PATENT NO. : 5,269,854

DATED : December 14, 1993

INVENTOR(S) : Akiko Takahashi et al.

It is certified that error appears in the above-indentified patent and that said Letters Patent is hereby corrected as shown below:

On title page, Abstract, line 4, change "type" to --class--.

Title page, Abstract, line 8, delete "phase".

Claim 5, column 7, line 28, change",$Co_x$" to --$Co_x$--.

Claim 12, column 8, line 14, after "<x" delete "-".

Claim 17, column 8, line 31, change "compound" to --compounds--.

Signed and Sealed this

Eighteenth Day of October, 1994

Bruce Lehman

*Attest:*

BRUCE LEHMAN

*Attesting Officer*

*Commissioner of Patents and Trademarks*